United States Patent [19]

Kinsley

[11] Patent Number: 4,782,985

[45] Date of Patent: Nov. 8, 1988

[54] CLOSURE FOR DRIP AND POUR DISPENSING

[75] Inventor: John P. Kinsley, Crystal Lake, Ill.

[73] Assignee: Seaquist Closures, Crystal Lake, Ill.

[21] Appl. No.: 17,069

[22] Filed: Feb. 20, 1987

[51] Int. Cl.[4] ..... B67D 3/00

[52] U.S. Cl. ..... 222/481.5; 222/484; 222/498; 222/546; 222/556

[58] Field of Search ..... 222/478, 481, 482, 483, 222/484, 485, 486, 481.5, 545, 546, 498, 487, 556

[56] References Cited

U.S. PATENT DOCUMENTS

| | | | |
|---|---|---|---|
| 1,595,540 | 8/1926 | Berrien | 222/478 |
| 1,731,560 | 10/1929 | Brown | 222/478 |
| 3,059,816 | 10/1962 | Goldstein | 222/109 |
| 3,204,829 | 9/1965 | Song | 222/153 |
| 3,419,198 | 12/1968 | Pettersen | 222/541 |
| 4,163,496 | 8/1979 | Dogliotti . | |
| 4,234,103 | 11/1980 | Strol et al. | 222/546 X |
| 4,291,818 | 9/1981 | Nozawa et al. . | |
| 4,358,032 | 11/1982 | Libit | 222/498 |
| 4,369,901 | 1/1983 | Hidding . | |
| 4,503,991 | 3/1985 | Joyce | 222/498 X |
| 4,615,462 | 10/1986 | Sacherer et al. . | |
| 4,700,858 | 10/1987 | Bennett | 222/498 X |

FOREIGN PATENT DOCUMENTS

| | | | |
|---|---|---|---|
| 0199673 | 10/1986 | European Pat. Off. | 222/498 |

*Primary Examiner*—F. J. Bartuska
*Assistant Examiner*—Stephen B. Parker
*Attorney, Agent, or Firm*—Dressler, Goldsmith, Shore, Sutker & Milnamow, Ltd.

[57] ABSTRACT

A drop and stream dispensing closure is provided for use on a container. The closure includes a closure structure for being mounted to the container, and the closure structure defines a dispensing opening and a vent opening. A cover is provided on the closure structure and includes sealing plugs for sealing both the vent and dispensing openings. The cover may be moved to an orientation in which the dispensing opening is open but the vent opening is closed. The cover may also be moved to a fully open orientation wherein both the vent opening and dispensing opening are open.

6 Claims, 2 Drawing Sheets

CLOSURE FOR DRIP AND POUR DISPENSING

TECHNICAL FIELD

This invention relates to closures for containers, and more particularly to a closure which includes means for accommodating the dispensing of the container contents drop-by-drop or in a continuous pour stream.

BACKGROUND OF THE INVENTION AND TECHNICAL PROBLEMS POSED BY THE PRIOR ART

Designs have been proposed for containers, especially containers for liquid, wherein a closure is provided with a spout for discharging the container contents and wherein the closure is also provided with an attached cover or plug for sealingly occluding the dispensing spout. See, for example, U.S. Pat. Nos. 3,419,198 and 3,059,816.

In order to accommodate the pouring of liquid materials from the spout of such closures, it has been proposed to include a vent in the closure for admitting air to the interior of the container as the liquid is being poured out through the dispensing spout. The U.S. Pat. No. 3,059,816 discloses designs for such a closure which includes an attached cap that, when positioned in engaging relationship upon the closure, fully occludes both the dispensing spout and the vent. Removal of the cap necessarily results in the opening of both the dispensing spout and the vent.

Although prior art designs for closures such as those discussed above may function well for the purposes for which they were designed, it has occurred to the inventor of the present invention that additional operational features would be desirable in many applications. Specifically, it may be advantageous in some applications to have the capability for dispensing the liquid contents from a container in either a steady pouring stream or in discrete drops so as to provide a sprinkling effect.

For example, with some types of liquid comestibles, such as soy sauce, it may be desired to provide for drop-by-drop dispensing onto food on a diner's plate. On the other hand, during the preparation of food in a kitchen, it may be desired to dispense larger quantities of the liquid in a steady, pouring stream. It would be beneficial if the same container could be used with an appropriate closure to alternatively dispense the liquid in a steady stream and drop-by-drop.

Further, with such an improved closure having the above-described alternate dispensing mode capability, it would be desirable to provide an integral, attached cover for sealing the container and for cooperating with the container to select the desired dispensing mode. This integral design would eliminate loose parts which might otherwise become separated from the closure and might perhaps become lost.

Additionally, it would be beneficial if such an improved closure could be provided with means for self-maintaining the closure in an appropriate operative orientation for dispensing the contents in the selected dispensing mode for as long as desired by the user.

Finally, such an improved closure should advantageously have a configuration that is relatively easy to manufacture from a variety of materials, and especially from conventional thermoplastic materials which are typically employed in containers for various liquids, particularly comestible liquids.

SUMMARY OF THE INVENTION

A dispensing closure or device is provided for use on an open mouth of a container to serve alternatively as a drop dispenser and as a pour (stream) dispenser. The closure includes a closure means for being secured or mounted on the container. The closure means defines a pair of openings, one of which serves as a dispensing opening or orifice and the other of which serves as a vent opening or orifice.

Means are provided for sealing both orifices in a fully closed position and for sealing only the vent orifice in an intermediate position while permitting discharge from the dispensing orifice.

In the preferred embodiment, a cover is provided to define and carry the orifice sealing means, and a snap-action hinge is employed to connect the cover with the closure means. In the preferred embodiment, the cover includes a separate dispensing orifice sealing means and a separate vent orifice sealing means which are joined by a connecting means —preferably, a snap-action hinge—to permit movement of the dispensing orifice sealing means relative to the vent orifice sealing means.

Numerous other features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this application and the accompanying drawings disclose only some specific forms as examples of the use of the invention. The invention is not intended to be limited to the embodiments so described, and the scope of the invention will be pointed out in the appended claims.

For ease of description, the closure of the invention is described in a position as it is usually encountered—upright on a container, and terms such as upper, lower, horizontal, etc., are used with reference to this position. It will be understood, however, that the closure of this invention may be manufactured, stored, transported, used, and sold in an orientation other than the position described.

Figure 1:
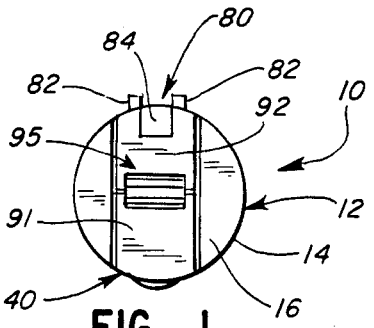
FIG. 1 is a top plan view of a first embodiment of the closure or dispensing device of the present invention.
Figure 2:
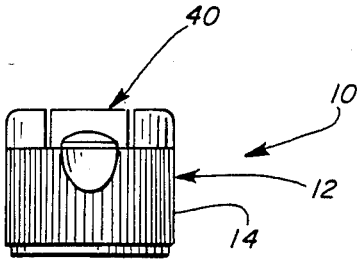
FIG. 2 is a front elevational view of the closure.
Figure 3:
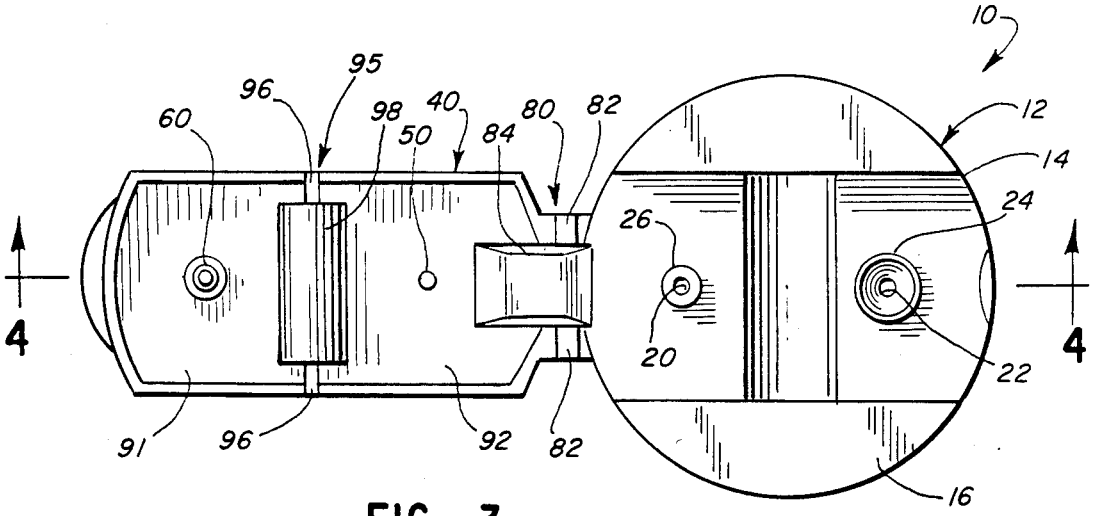
FIG. 3 is a greatly enlarged, top plan view of the closure with the cover moved to the fully opened position.
Figure 4:
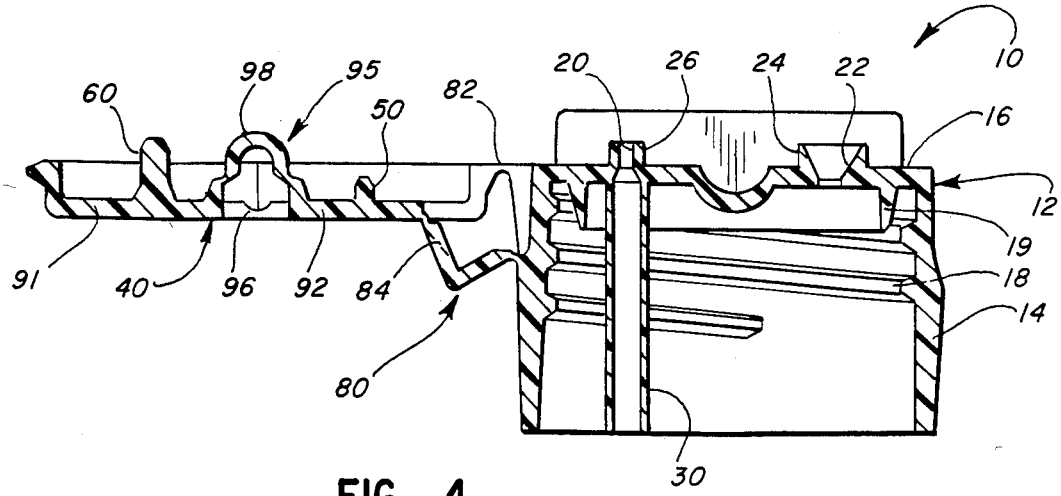
FIG. 4 is a cross-sectional view taken generally along the plane 4—4 in FIG. 3.

A first embodiment of the dispensing closure or dispensing device of the present invention is illustrated in FIGS. 1–4 wherein the closure is represented generally by reference numeral 10. The closure 10 is adapted to be mounted on a container (not illustrated) which may have a conventional open mouth defined by a neck or other suitable structure. As best illustrated in FIGS. 1 and 4, the closure 10 includes a closure means 12 for securement to the container. In the illustrated embodiment, the closure means 12 includes a body having a generally peripheral wall 14 and a generally disc-like, transverse closure wall 16.

As best illustrated in FIG. 4, the peripheral wall 14 includes, on its interior surface, threads 18 or other suitable means (e.g., snap-fit beads) for engaging suitable cooperating means on the container to releasably secure the closure means 12 on the container.

An annular sealing ring 19 may be provided as best illustrated in FIG. 4 for engaging the interior portion of the container at the container mouth for effecting a tight seal.

The closure means 12 includes a pair of openings, a vent opening or orifice 20 and a dispensing opening or orifice 22. In the preferred embodiment illustrated in FIGS. 1–4, the dispensing orifice 22 includes a raised spout 24 defining the dispensing opening 22, and the closure means includes a collar 26 defining the vent orifice 20. The vent orifice 20 may be in the form of a passage defined through an elongate tube 30 extending downwardly from the closure means transverse wall 16 as best illustrated in FIG. 4.

The closure or device 10 also includes a complete cover 40, but the cover may, if desired, be only a partial cover. The cover 40 defines means for sealing both orifices 20 and 22. In particular, the cover 40 includes a vent orifice sealing means in the form of a plug 50 and a dispensing orifice sealing means in the form of a plug 60. Each plug 50 and 60 is adapted to at least partially enter into the orifice 20 and 22, respectively, for sealingly occluding the orifice when the cover 40 is in the closed position as illustrated in FIGS. 1 and 2. It is to be understood that the orifices 20 and 22 and the associated sealing means 50 and 60 may have other suitable configurations.

In the preferred form of the invention illustrated in the Figures, the cover 40 is hingedly secured or connected to the closure means 12 for accommodating movement of the cover 40 to the fully open position illustrated in FIGS. 3 and 4. Preferably, the cover 40 is hingedly attached to the closure means 12 with a snap-action hinge 80 (FIG. 1), and the hinge 80 includes two spaced-apart main hinges 82 and an offset connecting link 84.

As the cover 40 is moved from a closed, engaging position on the closure means 12 to the fully open position, the link 84 deforms elastically through a dead center position at which the link is maximally deformed. On either side of the dead center position, the deformation of the link 84 is at least partly reduced and the cover 40 is urged to a stable position at the end of its travel range on that side of the dead center position. This is conventionally described as the "snap-action effect." One stable position of the snap-action hinge 80 is shown in FIGS. 1 and 2, and the other stable position of hinge 80 is shown in FIGS. 3 and 4.

The cap 40 functions as a means for connecting the vent orifice sealing means plug 50 with the dispensing orifice sealing means plug 60 in a novel manner. Specifically, the cap has two substantially rigid portions, a first portion 91 and a second portion 92, which are connected by a snap-hinge 95 comprising a pair of spaced-apart main hinges 96 and a deformable link 98.

The link 98 functions in substantially the same manner as the link 84 in that the link 98 deforms elastically as the cover portion 91 is pivoted about the main hinges 96, relative to the cover portion 92, from one side to the other of a dead center position. In FIG. 4, the cover portions 91 and 92 are shown in one stable position for snap-action hinge 95, it being realized that the other stable position of snap-action hinge 95, although not illustrated, would be defined by the cover portion 91 pivoted approximately 165° about main hinges 96 relative to the cover portion 92. The two stable positions of the snap-action hinge 95 are independent of the positions of the snap-action hinge 80 and vice versa.

Figure 5:
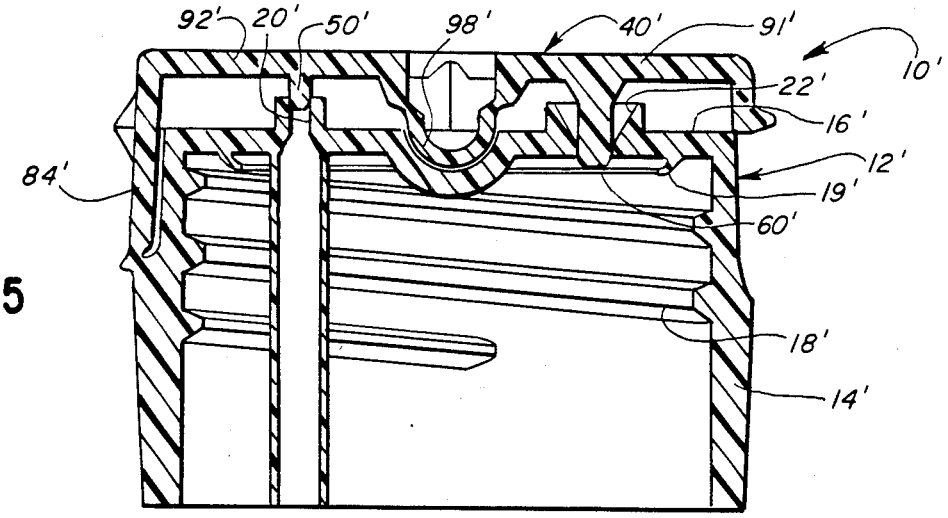
FIG. 5 is a cross-sectional elevational view of a second embodiment of the closure or dispensing device of the present invention shown with the cover in the fully closed position.
Figure 6:
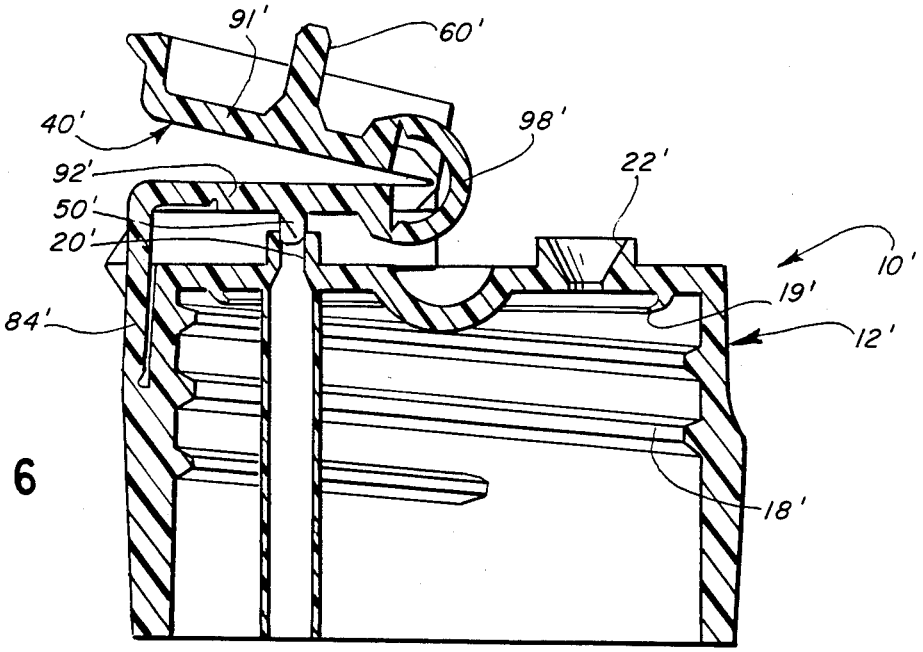
FIG. 6 is a view similar to FIG. 5 but showing the cover in an intermediate position to open the dispensing orifice while closing the vent orifice.
Figure 7:
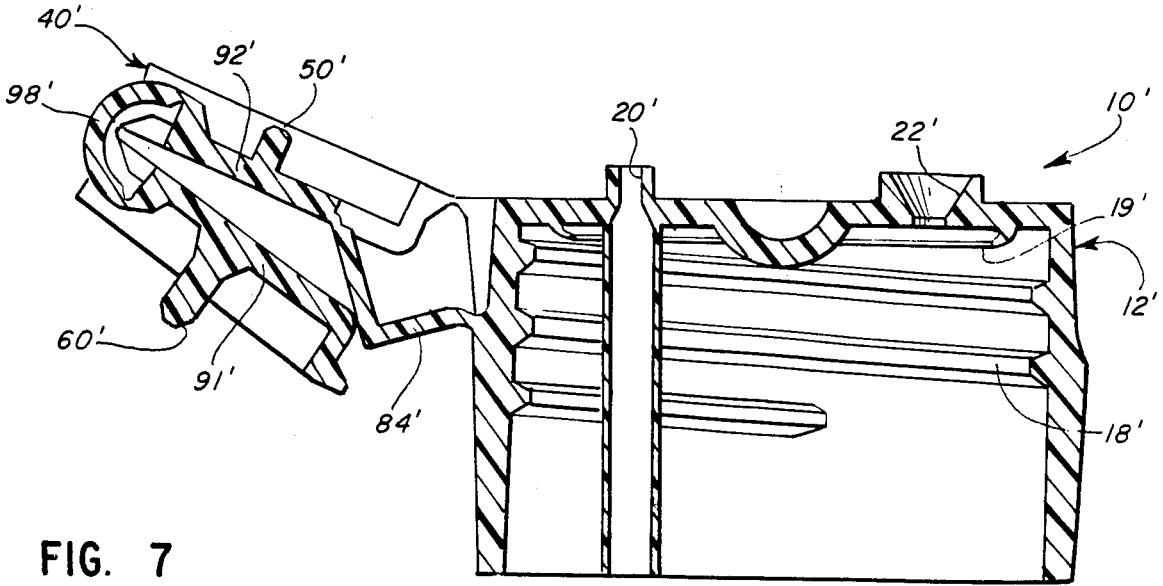
FIG. 7 is a view similar to FIG. 6 but showing the cover moved further to the fully opened position to open the vent orifice as well as the dispensing orifice.

With reference to FIGS. 3 and 4, it can be seen that if the cover portion 92 was closed (clockwise as viewed in FIG. 4) and if the cover portion 91 was pivoted back (as shown in sequence for the similar second embodiment illustrated in FIGS. 5–7), then the dispensing orifice sealing means spud 60 would be disengaged from the dispensing orifice 22. However, the vent orifice sealing means spud 50 would be engaged with the vent orifice 20. With the cover 40 in such an orientation, the container to which the closure 10 is mounted could not be vented through the vent orifice 20. Accordingly, discharge of a liquid from the container by the usual process of inverting the container would not result in a constant, steady flowing discharge stream. Rather, the liquid would tend to discharge in intermittent drops. Typically, dispensing the liquid from the container through the dispensing orifice 22 would be aided in such a case by tapping or shaking the container to alternately dispense a drop from the closure and then permit ingress of air through the dispensing orifice 22. In any event, dispensing of the liquid through the relatively small orifice 22 would result in a substantially drop-by-drop dispensing action. This would be useful in dispensing many kinds of liquids wherein only relatively small or controlled quantities are desired.

If it is desired to discharge a liquid through the closure 10 in a flowing stream, the second portion 92 of the cover 40 can be lifted away from the vent orifice 20, and the snap-action hinge link 84 will maintain the cover 40 spaced away from the vent orifice 20. The vent orifice will permit ingress of air in a substantially continuous flow, and this results in a substantially continuous discharge of the liquid from the container through the dispensing orifice 22 in a steady stream.

Of course, the cover portions 91 and 92 could also be initially fully opened to the "straight line" orientation illustrated in FIGS. 3 and 4 without necessarily leaving the snap-action hinge 95 in pivoted position wherein cover portion 91 is at an angle to the cover portion 92.

A second embodiment of the closure of the present invention is illustrated in FIGS. 5–7 wherein the closure is represented generally by the reference numeral 10'. The closure 10' is similar to the closure 10 illustrated in FIGS. 1–4 discussed above. The closure 10' includes a closure means 12' with a peripheral wall 14' and a generally disc-like transverse closure wall 16' defining a vent orifice 20' and a dispensing orifice 22'. A cover 40' is provided with a vent orifice sealing plug 50' on a cover portion 92' and a dispensing orifice sealing plug 60' on a cover portion 91'.

Unlike the first embodiment 10 illustrated in FIGS. 1–4 discussed hereinbefore, the cover 40' of the second embodiment 10' extends completely across and over the closure means transverse wall 16' Further, the closure means 12' is provided with a smaller, accurate sealing flange 19'.

In other respects, the second embodiment of the closure 10' is substantially identical to the first embodiment closure 10 and operates in the same manner as the closure 10. To this end, the closure 10' includes a snap-action hinge link 84' and a snap-action hinge link 98'. These function to maintain the cover 40' in the fully closed position as illustrated in FIG. 5 and to accommodate the intermediate position of the cover 40' as illustrated in FIG. 6 wherein the dispensing orifice 22' is open. The hinge links also function to accommodate the fully open position as illustrated in FIG. 7 wherein both the dispensing orifice 22' and the vent orifice 20' are open. In the fully open position, the cover portions 91' and 92' may be in the pivoted orientation as illustrated or may be in the "straight-line" orientation (such as illustrated for the first embodiment cover portions 91 and 92 in FIG. 4).

The novel closure of the present invention may be molded in one piece, thus replacing more complex closures requiring separate plugs and overcap structures. The closure of the present invention accommodates both drop-by-drop dispensing and continuous stream dispensing. The alternate dispensing mode capability is provided by the closure in a one-piece design that prevents loss of separate parts. The advantageous operation of the closure can be effected without removing the closure or any part thereof from the container to which the closure is attached.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A dispensing device for an open mouth of a container to serve alternatively for dispensing the container contents in drops and in a pour stream, said device comprising:

closure means for being mounted over said open mouth on said container, said closure means including a closure wall to occlude said container open mouth, said closure wall defining a contents dispensing orifice and a vent orifice;

a first cover portion having a dispensing orifice sealing means for releasably engaging said closure means for occluding said dispensing orifice;

a second cover portion having a vent orifice sealing means for releasably engaging said closure means for occluding said vent orifice;

main snap-action hinge means for mounting said second cover portion to said closure means to bias said second cover portion relative to said closure means in a first state to an engaged position in which at least said vent orifice sealing means occludes said vent orifice and in a second state to an open position in which said vent orifice sealing means is spaced from said vent orifice to open said vent orifice; and connecting snap-action hinge means for connecting said second cover portion with said first cover portion to bias said first cover portion in a first state to a first position relative to said second cover portion and in a second state to a second position relative to said second cover portion whereby, when said second cover portion is in said engaged position, said first position of said first cover portion occludes said dispensing orifice and said second position of said first cover portion is spaced from said dispensing orifice to open said dispensing orifice.

2. The device in accordance with claim 1 in which said vent orifice includes a passage defined through an elongate tube.

3. The device in accordance with claim 1 in which said closure means includes a spout defining said dispensing orifice and a collar defining said vent orifice.

4. The device in accordance with claim 1 in which said dispensing orifice sealing means and said vent orifice sealing means each include a plug for at least partially entering the respective orifice.

5. The device in accordance with claim 1 in which said closure means includes a body having a generally cylindrical peripheral wall and in which said closure wall is generally dis-like.

6. The device in accordance with claim 5 in which said peripheral wall includes securing means for engaging cooperating means on said container to releasably secure said closure means on said container.

* * * * *

UNITED STATES PATENT AND TRADEMARK OFFICE

CERTIFICATE OF CORRECTION

PATENT NO. : 4,782,985

DATED : November 8, 1988

INVENTOR(S) : John P. Kinsley

It is certified that error appears in the above-identified patent and that said Letters Patent is hereby corrected as shown below:

Column 6, line 43, "dis-like" should be --disc-like--.

Signed and Sealed this

Twenty-eighth Day of March, 1989

*Attest:*

DONALD J. QUIGG

*Attesting Officer*

*Commissioner of Patents and Trademarks*